United States Patent [19]

Potter et al.

[11] 4,257,765

[45] Mar. 24, 1981

[54] COLOR CORRECTED FLASH LAMP

[75] Inventors: Ralph M. Potter, Pepper Pike; John R. Debesis, Chagrin Falls, both of Ohio

[73] Assignee: General Electric Company, Schenectady, N.Y.

[21] Appl. No.: 916,471

[22] Filed: Jun. 19, 1978

[51] Int. Cl.[3] ..... F21K 5/00

[52] U.S. Cl. ..... 431/360

[58] Field of Search ..... 431/360

[56] References Cited

U.S. PATENT DOCUMENTS

| | | | |
|---|---|---|---|
| 2,305,609 | 12/1942 | Eaton | 431/360 |
| 2,465,068 | 3/1949 | Dana | 431/360 |
| 2,571,607 | 10/1951 | Pipkin et al. | 431/360 |
| 3,242,701 | 3/1966 | Shaffer | 431/360 |
| 4,099,090 | 7/1978 | Corth | 313/487 |

*Primary Examiner*—Carroll B. Dority, Jr.

*Attorney, Agent, or Firm*—John F. McDevitt; Lawrence R. Kempton

[57] ABSTRACT

Color correction means for flash lamp are disclosed which utilizes a blue emitting organic phosphor medium to increase the total light output being emitted from the flash lamp and lower the Spectral Distribution Index (SDI) of the lamp-phosphor combination. The phosphor medium can be employed as a coating for the light-transmitting envelope of the flash lamp wherein the phosphor constituent is dissolved in a transparent film forming polymer. In certain preferred embodiments, further color correction of the flash lamp radiation can be effected with dyes incorporated into the protective cover means or containment lacquer now commonly employed.

11 Claims, 1 Drawing Figure

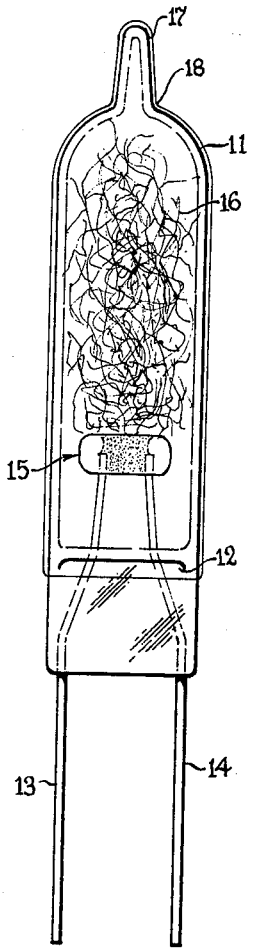
17
18
11
16
15
12
13
14

COLOR CORRECTED FLASH LAMP

BACKGROUND OF THE INVENTION

The color correction of flash lamps is ordinarily achieved by incorporating a blue dye in either the containment coating on the light transmitting envelope or by having the blue dye incorporated into the protective cover means commonly employed with a multilamp photoflash array. In either case the dye operates as a filter reducing the light output otherwise emitted when the lamp is flashed and the amount of light loss is especially severe for a multilamp photoflash array utilizing diffuse reflector means by reason of the poor blue light reflecting ability of the pigments now used in said reflectors.

A recently developed multiple flash lamp array of the latter type is disclosed in U.S. patent application Ser. No. 825,608, Harihar D. Chevali, filed Aug. 18, 1977 and now Pat. No. 4,136,379, and assigned to the assignee of the present invention. In said patent application a planar array of flash lamps is connected to a circuit board providing switching means to cause sequential flashing of the individual lamps and having a general configuration such as earlier disclosed in another U.S. Pat. No. 3,935,442 to Hanson also assigned to the present assignee. The circuit board member disclosed in the aforementioned patent application can be made of an electrically insulative light-reflecting material such as polystyrene containing titanium dioxide pigment dispersed therein in order to have the front surface serve as a reflector thereby eliminating need for any separate reflector member in the array. Electrical circuit runs can be provided on the reflective front surface of said circuit board to permit said front surface to function in a dual capacity of carrying the flash sequencing circuitry thereon as well as reflecting light therefrom when the lamps are flashed. A transparent cover member houses the entire flash lamp array and said member can further include a blue dye incorporated in the polymer material of construction to secure any desired color correction.

Multilamp photoflash arrays having different structural configurations are also disclosed in U.S. Pat. No. 3,758,768, Roy A. Secura, and assigned to the present assignee. The protective cover means disclosed for said flash arrays is said to be suitably tinted with a blue dye to serve as an optical filter if color correction is desired. There is further mentioned in said patent of the conventional lacquer film coating such as cellulose acetate customarily employed on the exterior surface of the light-transmitting envelope of each flash lamp to provide containment protection against glass shattering when the lamps are flashed. The incorporating of blue dyes in said protective lamp coating as another means for color correction has also been recognized.

SUMMARY OF THE INVENTION

It has now been discovered that color correction can be provided for a flash lamp by means which does not produce light loss and serves to desirably lower the spectral distribution index. As used in the present description, the term "Spectral Distribution Index" means the standard method for evaluating effective spectral energy distribution of blue photoflash lamps as described in a USAS Publication No. PH2.28-1967 and as expressed by a three-number designation describing the spectral emission characteristics of a light source in terms of the relative photographic responses of the three-component emulsions used in ordinary color film. Specifically, the present color correction means for a flash lamp comprises a blue emitting organic phosphor medium used in combination with the flash lamp so as to increase the total light output of said combination and produce a lower Spectral Distribution Index (SDI). As distinct from the previously employed filter means to achieve color correction wherein the light output from the flash lamp was absorbed in the "non-blue" spectral regions for a decreased light output as much as 15 to 20 percent, the present color correction means increases the color temperature by adding blue light being emitted by the phosphor constituent of the lamp-phosphor combination and thereby increases the total light output therefrom. The phosphor constituent operates in this manner by absorbing the radiation being emitted from the flash lamp in the spectral region below about 390 nm to convert said radiation with a high quantum efficiency to visible radiation in the wavelength region from approximately 400 nm to approximately 460 nm and having a peak wavelength at about 420 nm. It is also possible in accordance with the present invention to achieve further color correction at lower SDI values through additional use of conventional blue dye filtering means, as hereinafter more fully described, although to do so produces some light loss from such combined means.

In a preferred embodiment, the organic phosphor medium comprises a soluble phosphor compound dissolved in a light transmitting coating which is deposited on the surface of the light transmitting envelope employed for the flash lamp. Such coating can be deposited on the exterior surface of said flash lamp envelope to further serve as protective reinforcement against possible flash lamp explosion when actuated. Suitable color correcting phosphor constituents for use in this manner can be selected from the class of aromatic compounds which include 1,4-bis(2-methylstyryl) benzene, 2-(1-naphthyl)-5-phenyloxazole, 1,4-bis [(2-(5-phenyloxazolyl)] benzene and 7-amino-4-methyl coumarin. Especially effective color correction has been provided in said manner for multiple photoflash units of the type described in the above referenced U.S. Pat. Appln. Ser. No. 825,608, U.S. Pat. No. 4,136,379, and which further includes the incorporation of a blue dye in the polymer material serving as the protective cover means in said array.

BRIEF DESCRIPTION OF THE DRAWING

The accompanying FIGURE is a front elevation view of a color corrected flash lamp of the invention.

DESCRIPTION OF THE PREFERRED EMBODIMENTS

Referring to the accompanying drawing, there is shown a preferred flash lamp construction which comprises a tubular light-transmitting envelope 11 preferably made of borosilicate glass or other suitable light-transmitting vitreous material and having a stem press seal 12 at one end thereof through which a pair of inlead wires 13 and 14 extend from the exterior to the interior of the bulb 11 in a generally mutually parallel spaced apart manner to form a mount construction 15. The bulb 11 is partially filled above the mount 15 with a loose mass of filamentary or shredded metal wire or foil 16 of zirconium or hafnium, or other suitable combustible material. Air or another combustion supporting atmosphere such as oxygen fills the envelope often at a pressure of at least several atmospheres such as about 5–10 atmospheres or greater and the bulb is sealed off by an exhaust tip 17 at the other end thereof from the stem press seal 12. A color correcting coating 18 is deposited on the exterior surface of the lamp envelope 11 which can be in the form of a soluble phosphor compound dissolved in a light transmitting polymer coating.

The manner in which the above organic phosphor medium imparts the desired color correction as measured by a lower SDI value depends upon the number of considerations in the particular flash lamp construction. The reflector member customarily employed with most type flash lamps influences the amount and coloration of the light output depending upon its own reflective characteristics. For example, the metal or metallized specular type reflectors now in use generally do not absorb much light, hence do not require as much color correction as is required with a diffuse type reflector, especially one having a flat surface as distinct from a parabolic contour. As previously indicated, a flat surface diffuse type reflector disclosed in the aforementioned Ser. No. 825,608 patent application, U.S. Pat. No. 4,136,379, can include pigments which absorb blue light and thereby undesirably elevate the SDI value unless corrective action is taken. The correction means of the present invention adds blue emission by the organic phosphor medium to compensate for the absorbing characteristics of the latter type reflector members in order to lower the SDI values. A still different action attributable to the emission behavior of the present organic phosphor medium is not dependent upon the type reflector member being employed. Specifically, the blue emitting organic phosphor materials which have been found useful also absorb portions of the red and green emission being generated by the flash lamp reaction to varying degrees and thereby lower the SDI values in a different manner. Certain of said phosphor materials have been found more effective in this regard than can be achieved with the filtering dyes heretofore employed and with no comparable degree of light loss. It would thereby seem that the present invention has broad utility in flash lamp color correction to enable a given SDI value to be reached by selection of a proper organic phosphor constituent and which can be used in combination with a suitable dye to filter the composite flash lamp-phosphor light output. For such desired further coaction to occur, it becomes only necessary for the flash lamp emission to be transmitted through the transparent organic phosphor medium and the composite light output therefrom then to be filtered through a light transparent dye medium. Such desired light passage can be achieved with a further dye coating (not shown) being deposited upon the organic phosphor coating 18 shown in the above illustrated embodiment. Alternately, said organic phophor coating could be deposited on the major surface of the protective cover means closest to the flash lamps which is employed in the multilamp photoflash array as described in the previously referenced U.S. Pat. No. 3,758,768 and Ser. No. 825,608 patent application, now patent No. 4,136,379, with the dye constituent being incorporated in the transparent cover material.

Illustrative examples are given below upon specific organic phosphor materials when applied in accordance with the above described embodiment as a coating on the exterior flash lamp envelope surface. The SDI values reported on the phosphor coated flash lamps alone as well as when used in a multilamp photoflash array embodiment of the type described in the aforementioned U.S. patent application 825,608, U.S. Pat. No. 4,136,379, wherein the flash lamps are electrically connected to a circuit board member also serving as a diffuse type reflector member. Certain of these comparative results illustrate the further degree of color correction provided when a conventional blue filtering dye has been incorporated in the protective cover means employed with said multilamp photoflash array.

EXAMPLE 1

A customary reinforcing lacquer film coating was prepared utilizing approximately 14 percent by weight cellulose acetate dissolved in a suitable organic solvent. Various amounts of 1,4-bis-(2-methylstyryl) benzene blue emitting phosphor were dissolved in 1 kilogram of said lacquer coating to provide the phosphor medium for use in accordance with the present invention. High voltage type flash lamps were conventionally coated with said lacquers and SDI measurements made thereon when the coated lamps were flashed. Additional SDI measurements upon said coated lamps were flashed. Additional SDI measurements upon said coated lamps were made when incorporated into the aforementioned multilamp photoflash unit and all said measurements are reported in Table 1 below:

TABLE 1

| Phosphor Concentration (gms. per kilogram lacquer) Lacquer Solids | SDI VALUES | |
|---|---|---|
| | Coated Lamps | Flash Lamp Array (Optically clear cover means) |
| 0 | 0–8–16 | 0–11.9–21.4 |
| .0494 | 0–8.2–16.2 | 0–10.3–19.6 |
| .0247 | 0–7.0–14.7 | 0–10.5–19.5 |
| .0165 | 0–7.4–16.8 | 0–10.8–20.1 |

As can be noted from the above tests for both coated lamps and flash lamp arrays, the SDI values do not appear to depend strongly upon the phosphor concentrations in said coatings although color correction was generally achieved. A comparison between the flash lamp array values and the coated lamp values also points out the effect of a flat diffuse-type reflector which absorbs some of the light impinging upon said reflector surface. Specifically, said blue light absorption by the reflector member has the effect of raising the numerical values for the green and red components in said index.

EXAMPLE 2

Various amounts of a blue emitting p-bis[2-(5-phenyloxazolyl)] benzene phosphor were dissolved in the same cellulose acetate lacquer coating medium employed in Example 1. Correspondingly, said phosphor coatings where applied on the exterior surface of the same type flash lamps employed in said example and the same type flash lamp arrays also constructed therefrom but utilizing protective cover means of two types. Specifically, certain of the protective covers utilized an optically clear plastic material whereas the remaining covers incorporated a conventional filtering dye material in the polymer. Comparative SDI measurements made upon said flash lamp arrays are reported in Table 2 below along with the zonal lumen-seconds values (shown in parentheses) for the light output after passage through the respective cover means. Said reported zonal lumen-second values represent the amount of light measured by a square shaped opening in the direction perpendicular to the light source and further defined by a 20° angle from center in both horizontal and vertical planes.

TABLE 2

| Phosphor Concentration (gms. per kilogram lacquer) Lacquer Solids | SDI VALUES Clear Cover | Blue Cover |
|---|---|---|
| 0 | 0-11.8-21.1(534) | 0-6.5-8.3(426) |
| .0106 | 0-9.9-19.4(553) | 0-4.6-7.8(434) |
| .0210 | 0-10.4-19.3(561) | 0-3.4-4.6(425) |
| .0320 | 0-9.8-19.3(544) | 0-4.3-6.3(416) |

Again it is apparent from the above reported tests that SDI values do not appear to depend strongly upon the phosphor concentration in said coatings although color correction was generally achieved. It is also apparent from said measurements that a lower SDI is obtained in this manner without sacrificing the light output of the color corrected emission to any significant degree for the same type cover means. On the other hand, it can also be observed from said comparative measurements that a blue filtering dye significantly lowers the final light output.

From the foregoing description, it is evident that a broadly useful means for achieving color correction in a flash lamp without necessarily experiencing light loss has been disclosed. It will be apparent from said description to those skilled in the art, however, that various embodiments of the present invention other than above specifically disclosed are possible without departing from the spirit and scope thereof. For example, it is contemplated that dyes other than blue filtering dyes can be utilized with the present color correction means to vary the red and green components of the SDI values as desired. Likewise, the present blue emitting organic phosphor medium can be deposited on the inside surface of the flash lamp envelope with comparable results. It is still further contemplated to achieve all color correction according to the present invention without necessity of associated dye filtering means. Consequently, it is intended to limit the present invention only to the scope of the following claims.

What we claim as new and desire to secure by United States Letters Patent is:

1. A color corrected flash lamp having a light-transmitting envelope operatively associated with a blue emitting organic phosphor medium which upon exposure to the radiation being emitted by said flash lamp increases the total light output of said combination and lowers the Spectral Distribution Index thereby and a combustible light producing material in said envelope.

2. The color correction means of claim 1 wherein the organic phosphor medium comprises a soluble phosphor dissolved in a light-transmitting coating.

3. The color correction means of claim 2 wherein said coating is deposited on the exterior surface of the flash lamp envelope.

4. The color correction means of claim 2 wherein the soluble phosphor constituent is an aromatic compound selected from the group consisting of 1,4-bis(2-methylstyryl) benzene, 2-(1-naphthyl)-5-phenyloxazole, 1,4-bis[2-(5-phenyloxazolyl)]benzene, and 7-amino-4 methyl coumarin.

5. A color corrected flash lamp which comprises a hermetically sealed light-transmitting envelope, a combustible material distributed within said envelope along with a combustion supporting atmosphere, and flash ignition means located within said envelope which further includes a transparent coating deposited on the surface of the light-transmitting envelope, said coating comprising a blue emitting organic phosphor so as to increase the total light output upon flash lamp ignition and lower the Spectral Distribution Index thereby.

6. A color corrected flash lamp as in claim 5 wherein the flash ignition means includes a pair of spaced apart inleads and further includes a mass of primer material electrically connected to said inleads for ignition by a high voltage energy pulse.

7. A color corrected flash lamp as in claim 5 wherein the transparent coating is deposited on the exterior surface of the envelope.

8. A color corrected flash lamp as in claim 5 wherein the phosphor constituent is an aromatic organic compound selected from the group consisting of 1,4-bis(2-methylstyryl) benzene, 2-(1-naphthyl)-5-phenyloxazole, 1,4-bis[2-(5-phenyloxazolyl)]benzene, and 7-amino-4 methyl coumarin.

9. A multilamp photoflash array including a plurality of the flash lamps as in claim 5 and further including protective cover means.

10. A multilamp photoflash array as in claim 9 wherein the phosphor constituent is an aromatic organic compound selected from the group consisting of 1,4-bis( 2-methylstyryl) benzene, 2-(1-naphthyl)-5-phenyloxazole, 1,4-bis [2-(5-phenyloxazolyl)]benzene, and 7-amino-4-methyl coumarin.

11. A multilamp photoflash array as in claim 9 wherein said protective cover means further utilizes a dye to provide further color correction.

* * * * *